US006019646A

United States Patent [19]

Okamura et al.

[11] Patent Number: 6,019,646

[45] Date of Patent: Feb. 1, 2000

[54] FEMALE TERMINAL FITTING

[75] Inventors: Kenji Okamura; Yoshimasa Wada; Hiroyuki Oka, all of Yokkaichi, Japan

[73] Assignee: Sumitomo Wiring Systems, Ltd., Japan

[21] Appl. No.: 08/901,080

[22] Filed: Jul. 28, 1997

[30] Foreign Application Priority Data

Jul. 26, 1996 [JP] Japan ..... 8-197945

[51] Int. Cl.[7] ..... H01R 11/22

[52] U.S. Cl. ..... 439/852; 439/748

[58] Field of Search ..... 439/851, 852, 439/845, 850, 853, 801, 858, 861, 862, 748, 745

[56] References Cited

U.S. PATENT DOCUMENTS

| | | | |
|---|---|---|---|
| 5,540,603 | 7/1996 | Fujiwara | 439/851 |
| 5,562,501 | 10/1996 | Kinoshita et al. | 439/852 |
| 5,601,458 | 2/1997 | Ohsumi et al. | 439/852 |
| 5,611,715 | 3/1997 | Samejima | 439/850 |
| 5,643,018 | 7/1997 | Sakai et al. | 439/852 |
| 5,707,259 | 1/1998 | Ishizuka et al. | 439/852 |
| 5,769,673 | 6/1998 | Ohta et al. | 439/852 |
| 5,788,542 | 8/1998 | Miwa | 439/851 |

FOREIGN PATENT DOCUMENTS 60-99783 7/1985 Japan .

*Primary Examiner*—Steven L. Stephan
*Assistant Examiner*—Barry M. L. Standig
*Attorney, Agent, or Firm*—Banner & Witcoff, Ltd.

[57] ABSTRACT

A resilient contact 11 rise upwards diagonally towards the open end of an electrical terminal. A supporting member 11*b* is formed by folding an end of the contact 11 downwards and making the end of this folded over portion make contact with the base face of the protecting cover B. By these means, even if the point of contact is set towards the open end, the contact force can be maintained, and the rising member 11*a* is supported by the supporting member 11*b* when bending.

12 Claims, 5 Drawing Sheets

FEMALE TERMINAL FITTING

TECHNICAL FIELD

The present invention relates to a female terminal fitting of an electrical connector.

BACKGROUND TO THE INVENTION

Japanese Publication 60-99783 discloses a prior female terminal fitting of the type shown in FIG. 13 of this specification. The female terminal fitting has an insertion member 1 formed at the anterior end in an angular tubular shape, and its posterior end has a barrel member (not shown) for connecting an electric wire by crimping. The opening 1*a* at the anterior end is for inserting a corresponding male terminal fitting 2. The interior of the insertion member 1 has a tongue shaped resilient contact 3 formed by turning over the base plate from the lower edge of the opening 1*a*. This elastic contact 3 is bent up from the lower edge and then its posterior end is bent down, as illustrated.

When the male terminal fitting 2 is inserted into the insertion hole 1*a*, it bends the bent-over portion of the contact 3 downwards, and makes electrical contact therewith.

In a miniaturized connector, due to the need to increase the insertion depth of the male terminal fitting with respect to the contact or for other reasons, the point of contact with the male terminal fitting is required to be set to be more to the anterior. However, with this configuration, it becomes necessary to increase the upward angle of the contact at the portion where the folding over occurs. As a result, the resilience of the contact can be adversely affected. Further, the fact that the angle of bending is increased also means that the contact deteriorates more rapidly, thereby adversely affecting its life.

A possible alternative is to set the point of contact to the anterior not by folding over the contact from the anterior end but to raise it from the posterior end towards the anterior end. With such a configuration, even if the point of contact is set to be towards the anterior end, the upward angle of the contact is not large. As a result, the resilience of the contact is maintained satisfactorily, and the above-mentioned problem can be resolved. However, the fact that the steepness of the contact is decreased means that the resilient force of the contact also decreases. Consequently, a new problem arises in that the elastic contact cannot maintain sufficient engagement force with a male terminal fitting.

The present invention has been developed after taking the above problem into consideration, and aims to present a female terminal fitting wherein even if the point of contact is set to be towards the anterior end (the end from which the male terminal fitting is inserted), sufficient resilience and contact pressure are maintained.

SUMMARY OF THE INVENTION

According to the invention there is provided a female electrical terminal fitting having an aperture to receive a corresponding male terminal fitting on an internal resilient contact, said contact comprising a rising portion extending from one side wall of the terminal fitting towards said aperture and away from said side wall, and being folded under to constitute a supporting portion having a free end in contact with said side wall.

Such a terminal fitting enables the point of contact with a male terminal to be close to the mouth of the fitting, the supporting portion increasing the engagement force substantially. Such a terminal fitting can be formed integrally of sheet material, and is thus inexpensive. Preferably the supporting and rising portions extend in substantially the same direction, at a shallow angle to the direction of insertion of the male terminal.

In order to prevent excessive bending of the rising portion, due for example to angled entry of the male terminal, an excessive bending preventing member in the form of an abutment may be formed on the fitting, for example on the supporting portion as a bent tab.

An inward projection of the fitting may urge the supporting portion towards the rising portion and thus increase the resilient force thereof.

BRIEF DESCRIPTION OF DRAWINGS

Other features of the invention will be apparent from the following description of several preferred embodiments illustrated by way of example only in the accompanying drawings, in which.

DESCRIPTION OF PREFERRED EMBODIMENTS

A first embodiment of the present invention relating to a female terminal fitting is explained hereinbelow, with reference to FIGS. 1 to 7.

Figure 3:
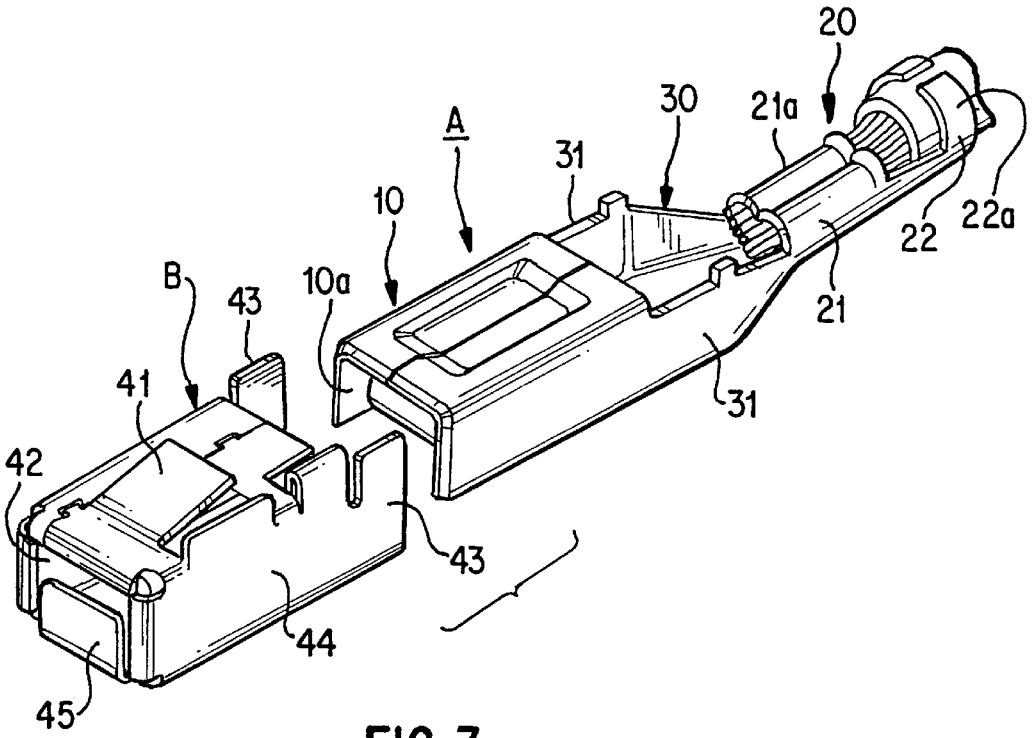
FIG. 3 is a disassembled diagonal view of the first embodiment showing a protecting cover and a terminal main body.

As shown in FIG. 3, a female terminal fitting of the present embodiment comprises a terminal main body A made from an electrically conducting metal sheet (for example, a thin copper alloy) that has been bent, and a protecting cover B that covers the terminal main body A.

The terminal main body A is configured so as to be provided with an insertion member 10 into which a corresponding male terminal fitting C (see FIG. 5) is inserted, and a barrel member 20 connected to the insertion member 10 via a connecting member 30, the terminal of an electric wire being connected by crimping thereto. The barrel member 20 comprises a wire barrel 21 that crimps a wire core of an electric wire, and an insulation barrel 22, connecting to the posterior side of the wire barrel 21, that crimps a covered portion of the electric wire. The barrels 21 and 22 protrude conventionally upwards as crimping members 21*a* and 22*a*.

Figure 1:
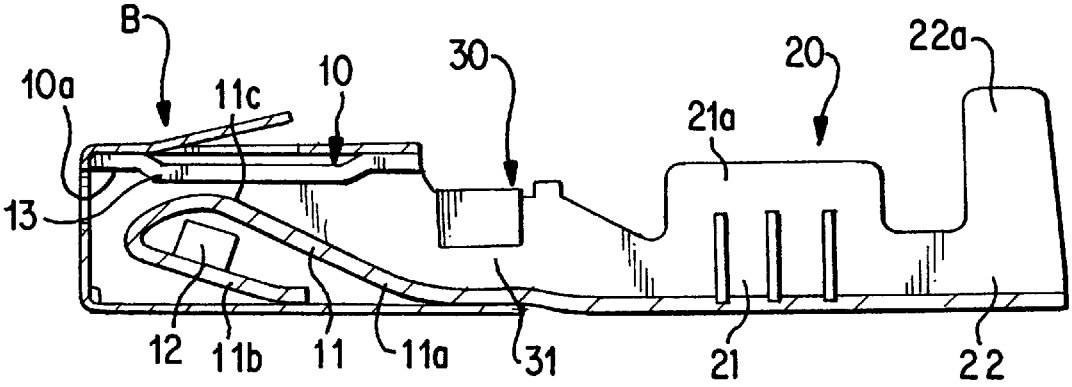
FIG. 1 is a side cross-sectional view showing the entirety of a first embodiment.
Figure 2:
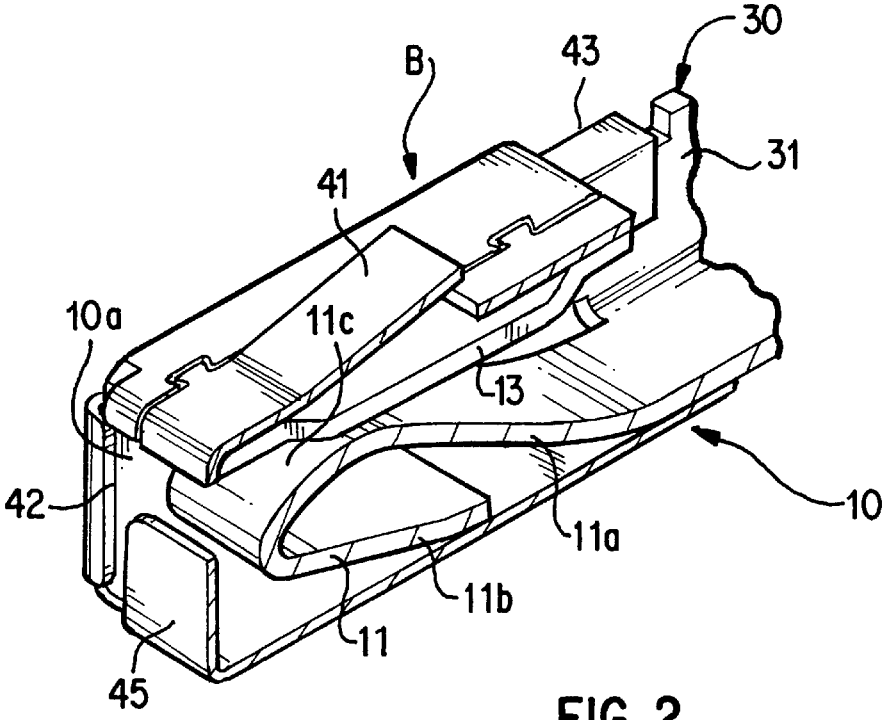
FIG. 2 is a partially cut-away diagonal view of the first embodiment showing the interior of an insertion member.

The insertion member 10 has a box shape and its anterior end face opens out, forming an insertion hole 10*a* for allowing the insertion of a male terminal fitting C. Furthermore, as shown in FIG. 1 and FIG. 2, a resilient contact member 11 is formed inside the insertion member 10 in a connected manner from the posterior end (the side where the barrel member 20 is located), the contact member 11 being formed by bending the base plate of the insertion member 10. In other words, in the unfolded state, the base plate extends further towards the anterior direction beyond its left and right side walls, which are connected from the left and right sides to the base plate. Furthermore, there are cuts provided between the base plate and the left and right side walls, these cuts extending along the lengthwise direction from the anterior edge up to a little before the posterior edge. The left and right walls are folded over and the base plate made to curve slightly upwards from the posterior end to the anterior end, the anterior end of the base plate being bent under. In this manner, the resilient contact member 11 is formed in the insertion member 10, and in this condition the contact member 11 protrudes to its highest point somewhat interiorly with respect to the insertion hole 10*a*, the end folded over downwards being approximately on the same plane as the base plate of the insertion member 10.

The portion rising up from the posterior end of the insertion member 10 towards the anterior corresponds to a rising member 11*a* of the present invention, and the portion folded over downwards corresponds to a supporting member 11*b*. The portion inside the inner side of the insertion hole 10*a* and bending upwards is a contacting member 11*c* that makes contact with the male terminal fitting C. The highest point is the point of contact with the male terminal fitting C.

The supporting member 11*b* has a pair of excessive bending preventing members 12 formed along the left and right side edges, approximately towards the centre in the lengthwise direction. The protrusion dimension of these preventing members 12 is such as to not make contact with the lower face of the rising members 11*a* in the case where the male terminal fitting C is inserted in the correct position. In other words, these are set to make contact with the lower face of the rising member 11*a* when the rising member 11*b* bends greatly due to, for example, the male terminal fitting C being inserted in an angled manner. The roof face in the insertion member 10 has a recessed member 13 that is recessed along approximately its length.

The connecting member 30 is formed in a tapered manner from the posterior end of the insertion member 10 to the anterior end of the barrel member 20. The side walls facing each other on the left and right sides have a crimping wall 31 for receiving a fixing member 43 of a protecting cover B, to be described later.

As shown in the left side of FIG. 3, the protecting cover B is formed by bending a stainless steel thin metal sheet into an angular tubular shape, its anterior end face and posterior end face being open. Its dimension in the lengthwise direction is slightly greater than the length of the insertion member 10, and its inner dimension is set to be slightly greater than the outer dimension of the insertion member 10. In other words, the protecting cover B can be inserted onto the insertion member 10, the lower end of the supporting member 11*b* in the elastic contact 11 making contact with the lower face of the protecting cover B.

The roof face of the protecting cover B has a lance 41 formed by cutting away so as to extend outwards from the anterior end. The right side wall of the protecting cover B (the more proximately located side wall in FIG. 3) protrudes slightly higher than the upper face, thereby constituting a protecting wall 44. The bending space of the lance 41 formed below is protected by the wall 44.

At the anterior end of the protecting cover B the lower edge of an opening edge is bent inwards approximately at a right angle, and as a result approximately the lower half of the opening is covered, and the collision of the male terminal fitting C, or the like, with the folded-over portion of the contact 11 is prevented. A through hole 42 is formed on the portion opening out to the upper side of a protecting member 45 for allowing the male terminal fitting C to pass through. The male terminal fitting C inserted therein is arranged to make contact with the contacting member 11*c*. The posterior end of the protecting cover B has the pair of fixing members 43 protruding upwards from the left and right side walls. When the protecting cover B is inserted over the insertion member 10, these fixing members 43 overlap with the crimping walls 31, and by bending these fixing members 43 inwards, the cover B is fixed. (See FIG. 1).

Figure 4:
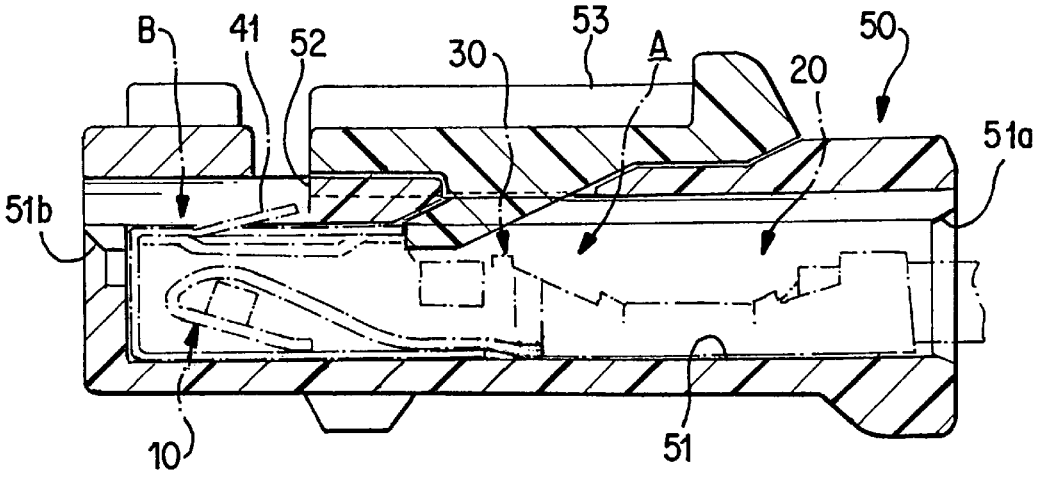
FIG. 4 is a side cross-sectional view showing an attached state of the first embodiment with the connector housing.
Figure 5:
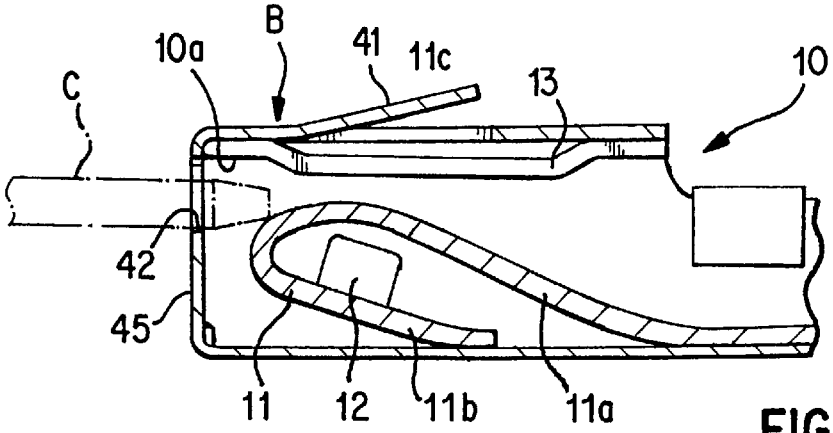
FIG. 5 is a side cross-sectional view showing a resilient contact during the process of insertion of a male terminal fitting.
Figure 6:
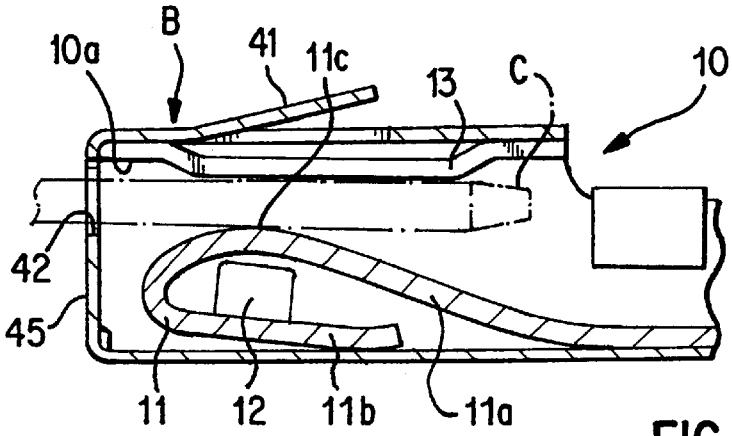
FIG. 6 is a side cross-sectional view showing the resilient contact after the insertion of the male terminal fitting is completed.

FIG. 4 shows the female terminal fitting when attached to a connector housing 50. This connector housing 50 has cavities 51 formed in a parallel manner in a sideways direction (the direction perpendicular to the face of the paper), the posterior ends of the cavities 51 (the right side in FIG. 4) having terminal attachment holes 51*a* for the female terminal fitting. The anterior sides (the left side in FIG. 4) have terminal through holes 51*b* for inserting the male terminal fitting C. The roof face of each cavity 51 has a stopping member 52 formed by cutting away, the lance 41 of the female terminal fitting therewith. A retainer 53 is attached to the upper face of the connector housing 50 to engage and retain the insertion member 10.

Next, the operation of the present embodiment is explained. When the male connector is fitted to the female connector having the female terminal fitting therein, it enters the through hole 42 and the insertion hole 10*a* (see FIG. 5). The contacting member 11*c* is pushed down and the rising member 11*a* is bent downwards about its root portion. As the rising member 11*a* bends, the lower edge of the supporting member 11*b* gradually pushes against the base face of the protecting cover B. When the male terminal fitting C is pushed in correctly, the free end of the supporting member 11*b* remains clear of the rising member 11*a*, since it curves up slightly from the base face. (see FIG. 6).

If however the male connector C is inserted at an angle, the rising member 11*a* is pushed excessively downwards. The excessive bending preventing member 12 makes contact with the rising member 11*a*, thereby preventing excessive bending and undue stress. (See FIG. 7).

Thus since the contact 11 rises from the posterior end towards the anterior end, even if the point of contact with the male terminal fitting C is set to be located at the anterior end, the angle of bending of the rising member 11*a* is not large, and a sufficient resilient force is maintained. Furthermore, the supporting member 11*b* is formed so as to be connected to the rising member 11*a*, and when the male terminal fitting C is inserted, the rising member 11*a* is bent while being supported by the supporting member 11*b*. Consequently, the force of the contact 11 can be increased. As a result, even with the point of contact with the male, terminal fitting C being set towards the anterior end, a sufficient force can be maintained.

Further, when the male terminal fitting C is inserted at an angle, or if it is manipulated while being inserted, etc., since the excessive bending preventing member 12 is provided, the rising member 11*a* is prevented from being excessively bent. Accordingly, the reliability of contact with the male terminal fitting can be increased.

Figure 8:
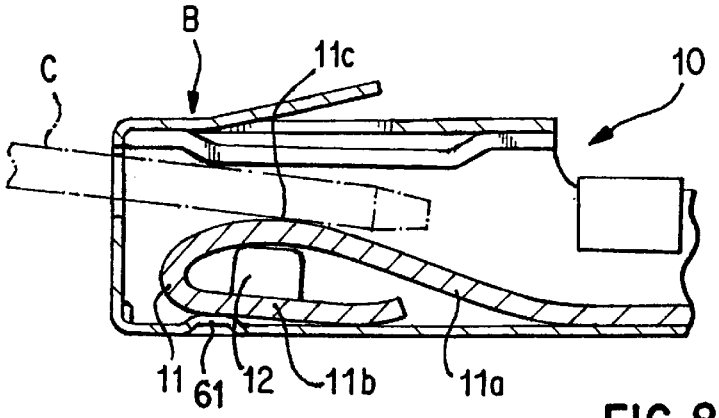
FIG. 8 is a side cross-sectional view of a second embodiment showing a resilient contact when the male terminal fitting is inserted diagonally.

A second embodiment is shown in FIG. 8. The lower side of a supporting member 11*b* of an elastic contact 11 has a pushing member 61 formed on the base face of a protecting cover B. Since the configuration of the other parts are the same as in the first embodiment, the same numbers are accorded to parts having the same configuration as in the first embodiment, and an explanation thereof omitted.

The pushing member 61 is formed by pressing in the lower face of the protecting cover B, the supporting member 11*b* being supported in the direction opposite to its bending direction when a male terminal fitting C is inserted.

Figure 7:
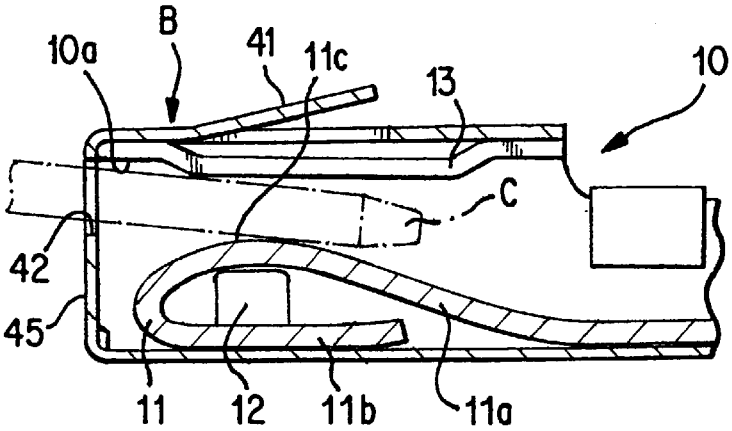
FIG. 7 is a side cross-sectional view showing the resilient contact when the male terminal fitting is inserted diagonally.

In the case where the male terminal fitting C is inserted at an angle, or if it is manipulated during insertion, the supporting member 11*b* is pushed with an excessive force against the base face of the protecting cover B. More specifically, if the pushing member 61 of the present embodiment is not provided, then, as shown in FIG. 7, approximately the entire supporting member 11*b* is pushed against the base face of the protecting cover B.

However, if, as in the present embodiment, the pushing member 61 is provided, even in the case where, for example, the male terminal fitting C is pushed in diagonally, the supporting member 11*b* makes contact with the pushing member 61 and does not bend beyond a specified extent, thereby making it possible for its end which connects with the rising member 11*a* to be raised slightly above the base face (see FIG. 8). Consequently, the rising member 11*a* is pushed towards the male terminal fitting C in the pushing direction, thereby increasing the contact force.

Figure 9:
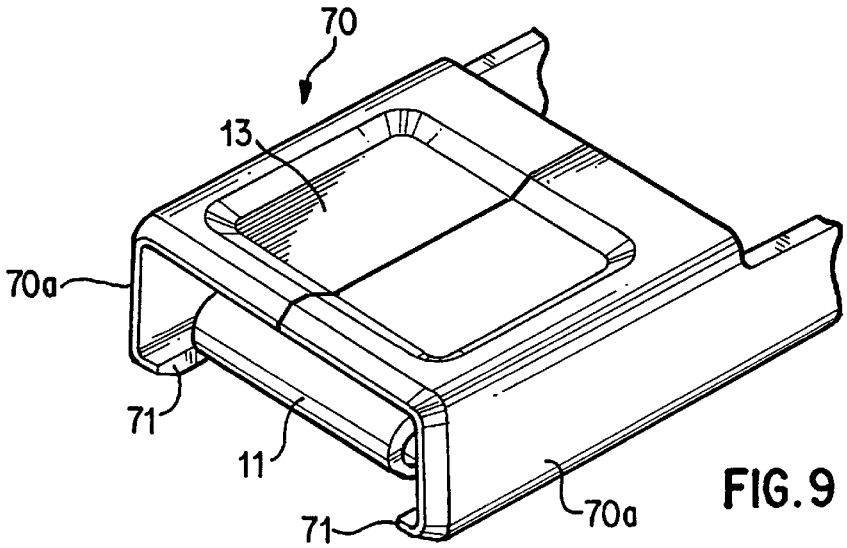
FIG. 9 is a diagonal view showing an insertion member of a third embodiment.
Figure 10:
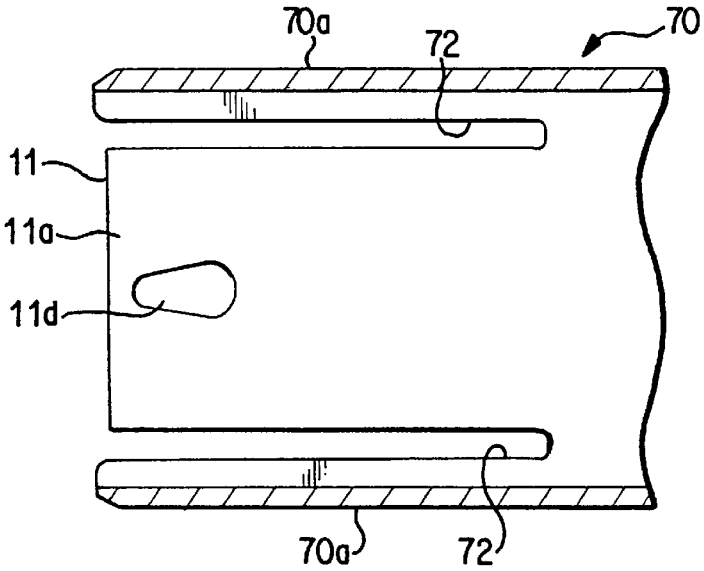
FIG. 10 is a cross-sectional view showing the insertion member of the third embodiment.
Figure 11:
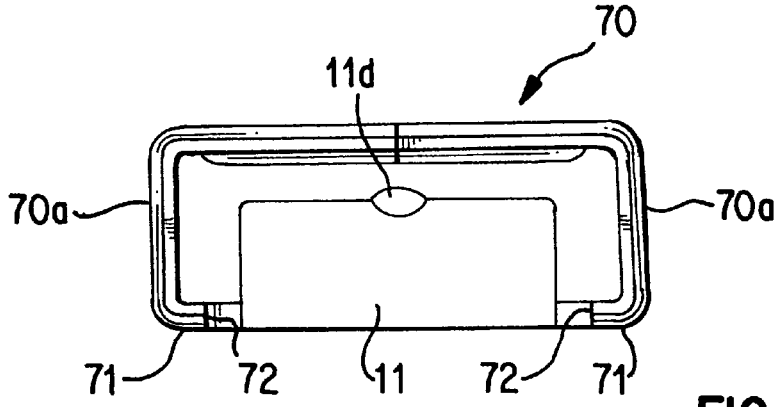
FIG. 11 is a front view of the insertion member of the third embodiment.
Figure 12:
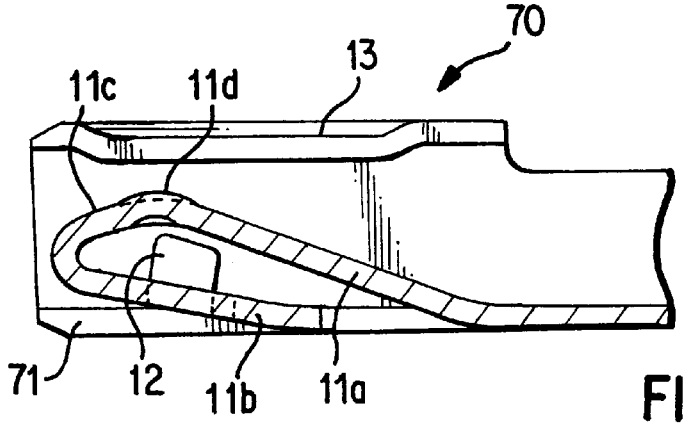
FIG. 12 is a side cross-sectional view of the insertion member of the third embodiment.
Figure 13:
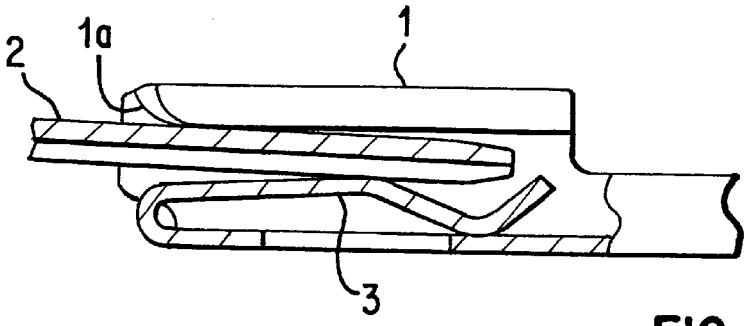
FIG. 13 PRIOR ART
FIG. 13 is a side cross-sectional view of a conventional terminal fitting.

A third embodiment is shown in FIGS. 9 to 11. The lower edge of an insertion member 70 has its left and right side walls 70*a* folded inwards, forming folded over members 71. When a contact 11 is cut out from the base plate, cuts 72 are formed slightly inwards with respect to the left and right side edges (the upper and lower edges in FIG. 11). The lower edge of the supporting member 11 folded over from the anterior side downwards is in approximately the same location as the folded over member 71 (see FIG. 12), and is set so as not to protrude downwards from the base face of the insertion member 70. The contacting member 11*c* has a protruding member 11*d* formed on the upper face thereof by pressing, and is arranged to make contact in a reliable manner with the male terminal fitting C (see FIG. 5). The configuration of the other parts being the same as in the first embodiment, the same numbers are accorded to parts having the same configuration as in the first embodiment, and an explanation thereof omitted.

By forming the folded over members 71 on the lower edges of the insertion member 70, the strength of side walls 70*a* can be increased. Further, the protruding member 11*d* in the improves contact with the male terminal fitting C. Since the lower edge of the supporting member 11*b* does not protrude from the base face of the insertion member 70, during assembly etc., the bending of this portion due to its making contact with another terminal fitting etc., can be avoided.

The present invention is not limited to the embodiments described above with the aid of figures. For example, the possibilities described below also lie within the technical range of the present invention.

(1) In each of the above embodiments, although an excessive bending preventing member 12 is provided, it may equally be arranged so that this is not provided.

(2) In each of the above embodiments, although the resilient contact 11 is formed by cutting it out from the base plate and its supporting member 11*b* made to make contact with the base face of the protecting cover B, it may equally be arranged so that the protecting cover is not provided and the base portion of the insertion member has a double base, and an upper base plate has a resilient contact formed thereon, the supporting member making contact with and pushing against a lower base plate.

(3) In each of the above embodiments, although the excessive bending preventing member 12 is formed on the supporting member 11*b*, it may equally be arranged so that it is formed on the protecting cover or the side face of the insertion member, etc.

(4) In the second embodiment, although it is arranged so that the pushing member 61 is formed taking into consideration the case where the male terminal fitting C is inserted diagonally, it may equally be arranged so that the pushing member is formed so as to make the supporting member rise up even further from the base face. In this manner, even in the case where the male terminal fitting is inserted correctly the contact pressure can be increased. In addition, the present invention may be embodied in various other ways without deviating from the scope thereof.

We claim:

1. A female electrical terminal fitting having an aperture to receive a corresponding male terminal fitting and an internal resilient contact, said contact comprising a rising portion extending from one side wall of the terminal fitting such that said rising portion extends away from said side wall in the direction of said aperture, and said contact further being folded under said rising portion adjacent said aperture to constitute a supporting portion having a free end in contact with said side wall.

2. A terminal fitting according to claim 1 wherein said rising portion and supporting portion extend in substantially the same direction.

3. A terminal fitting according to claim 1 and further including an excessive bending preventing member under said rising portion for preventing excessive bending by abutment therewith.

4. A terminal fitting according to claim 3 wherein said excessive bending preventing member is formed on said supporting portion.

5. A terminal fitting according to claim 2 and further including an excessive bending preventing member under said rising portion for preventing excessive bending by abutment therewith.

6. A terminal fitting according to claim 5 wherein said excessive bending preventing member is formed on said supporting portion.

7. A terminal fitting according to claim 1 and further including a projection extending inwardly from said side wall, said projection being in contact with said supporting portion and spaced from the free end thereof.

8. A terminal fitting according to claim 1 and constituted of sheet metal.

9. A terminal fitting according to claim 1 wherein said aperture is positioned to guide a male terminal over said rising portion.

10. A terminal fitting according to claim 1 and comprising a terminal having said contact formed integrally therefrom, and a housing for said terminal, one wall of said housing constituting said side wall.

11. A terminal fitting according to claim 1 wherein said rising portion includes an upstanding contact protrusion at the peak thereof.

12. A terminal fitting according to claim 11 wherein said protrusion is formed as a raised portion of a surface of said rising portion.

* * * * *